US010669977B2

(12) United States Patent
Tanaka et al.

(10) Patent No.: US 10,669,977 B2
(45) Date of Patent: Jun. 2, 2020

(54) FUEL PIPE

(71) Applicant: TOYOTA JIDOSHA KABUSHIKI KAISHA, Toyota-shi (JP)

(72) Inventors: Masayuki Tanaka, Toyota (JP); Tomihisa Tsuchiya, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 16/261,681

(22) Filed: Jan. 30, 2019

(65) Prior Publication Data

US 2019/0249632 A1 Aug. 15, 2019

(30) Foreign Application Priority Data

Feb. 13, 2018 (JP) ..... 2018-023190

(51) Int. Cl.
*F02M 55/00* (2006.01)
*F02M 69/46* (2006.01)
*F02M 37/00* (2006.01)

(52) U.S. Cl.
CPC ..... *F02M 55/004* (2013.01); *F02M 37/0017* (2013.01); *F02M 55/00* (2013.01); *F02M 69/465* (2013.01)

(58) Field of Classification Search
CPC .... F02M 55/00; F02M 55/002; F02M 55/004; F02M 55/005; F02M 55/007; F02M 55/02; F02M 55/025; F02M 37/0017; F02M 37/0041; F02M 69/465
See application file for complete search history.

(56) References Cited

U.S. PATENT DOCUMENTS 4,971,014 A * 11/1990 Usui ..... F02M 69/465 123/468
7,347,190 B1 * 3/2008 Keegan ..... F02M 55/02 123/456
2006/0254563 A1 * 11/2006 Keegan ..... F02M 55/02 123/456
2010/0012091 A1 * 1/2010 Kannan ..... F02M 55/004 123/447
2013/0319375 A1 * 12/2013 Bolz ..... B21O 37/08 123/456
2015/0136084 A1 * 5/2015 Maier ..... F02M 55/025 123/452
2017/0260942 A1 * 9/2017 Kawaguchi ..... F02M 37/0052
2018/0128223 A1 * 5/2018 Park ..... F02M 55/025
2019/0111527 A1 * 4/2019 Serra ..... B23K 37/06
2019/0366507 A1 * 12/2019 Urban ..... B24O 3/325

FOREIGN PATENT DOCUMENTS

JP 06-029496 8/1994
JP 2014-008638 1/2014

* cited by examiner

*Primary Examiner* — Thomas N Moulis
(74) *Attorney, Agent, or Firm* — Oblon, McClelland, Maier & Neustadt, L.L.P.

(57) ABSTRACT

A fuel pipe includes a tubular header pipe and a socket coupled to the header pipe and supplied with fuel from the header pipe. The header pipe and the socket form a joining portion therebetween. The joining portion is shaped to be elongated in a first direction. The joining portion includes a communication hole that connects an inner region of the header pipe and an inner region of the socket. The communication hole is an elongated hole elongated in the first direction.

4 Claims, 7 Drawing Sheets

FUEL PIPE

BACKGROUND

The present invention relates to a fuel pipe.

Japanese Examined Utility Model Publication No. 6-29496 describes a fuel pipe that distributes and supplies fuel fed by a fuel pump to a plurality of fuel injection valves. The fuel pipe includes a cylindrical header pipe. The header pipe includes a fuel inlet through which the fuel fed from the fuel pump is drawn and a plurality of fuel outlets through which the fuel is supplied from the header pipe to the fuel injection valves. The fuel outlets are arranged next to each other in the axial direction of the header pipe. The bases of the fuel injection valves are fitted into corresponding fuel outlets in a liquid-tight manner. When the fuel is injected from the fuel injection valves, fuel is supplied from the header pipe to the fuel injection valves through the fuel outlets.

The fuel pipe may be constructed by molding the header pipe separately from the fuel outlets and then coupling the fuel outlets to the header pipe. In such a construction, the header pipe includes a communication hole at a joining portion where each fuel outlet is connected to the header pipe. A flow passage extending through the fuel pipe has a cross-sectional area that is smaller at portions where the fuel outlets are located than other portions. Thus, in a situation immediately after the injection of fuel from each fuel injection valve, the flow rate of fuel is restricted at the communication hole. This momentarily causes the fuel pressure at the fuel outlet side to which the fuel injection valve is connected to be lower than the fuel pressure at the header pipe side. Such a difference in fuel pressure may vibrate the fuel pipe. It is desirable that the difference in fuel pressure be reduced by increasing the area of the communication hole while properly maintaining the required coupling strength between the header pipe and the fuel outlet. However, the above publication does not describe such matter thereby leaving room for improvement.

SUMMARY

A fuel pipe according to one embodiment of the present invention includes a tubular header pipe and a socket coupled to the header pipe and supplied with fuel from the header pipe. The header pipe and the socket form a joining portion therebetween. The joining portion is shaped to be elongated in a first direction. The joining portion includes a communication hole that connects an inner region of the header pipe and an inner region of the socket. The communication hole is an elongated hole elongated in the first direction.

Other aspects and advantages of the embodiments will become apparent from the following description, taken in conjunction with the accompanying drawings, illustrating by way of example the principles of the invention.

BRIEF DESCRIPTION OF THE DRAWINGS

The embodiments, together with objects and advantages thereof, may best be understood by reference to the following description of the presently preferred embodiments together with the accompanying drawings in which.

DETAILED DESCRIPTION

Figure 1:
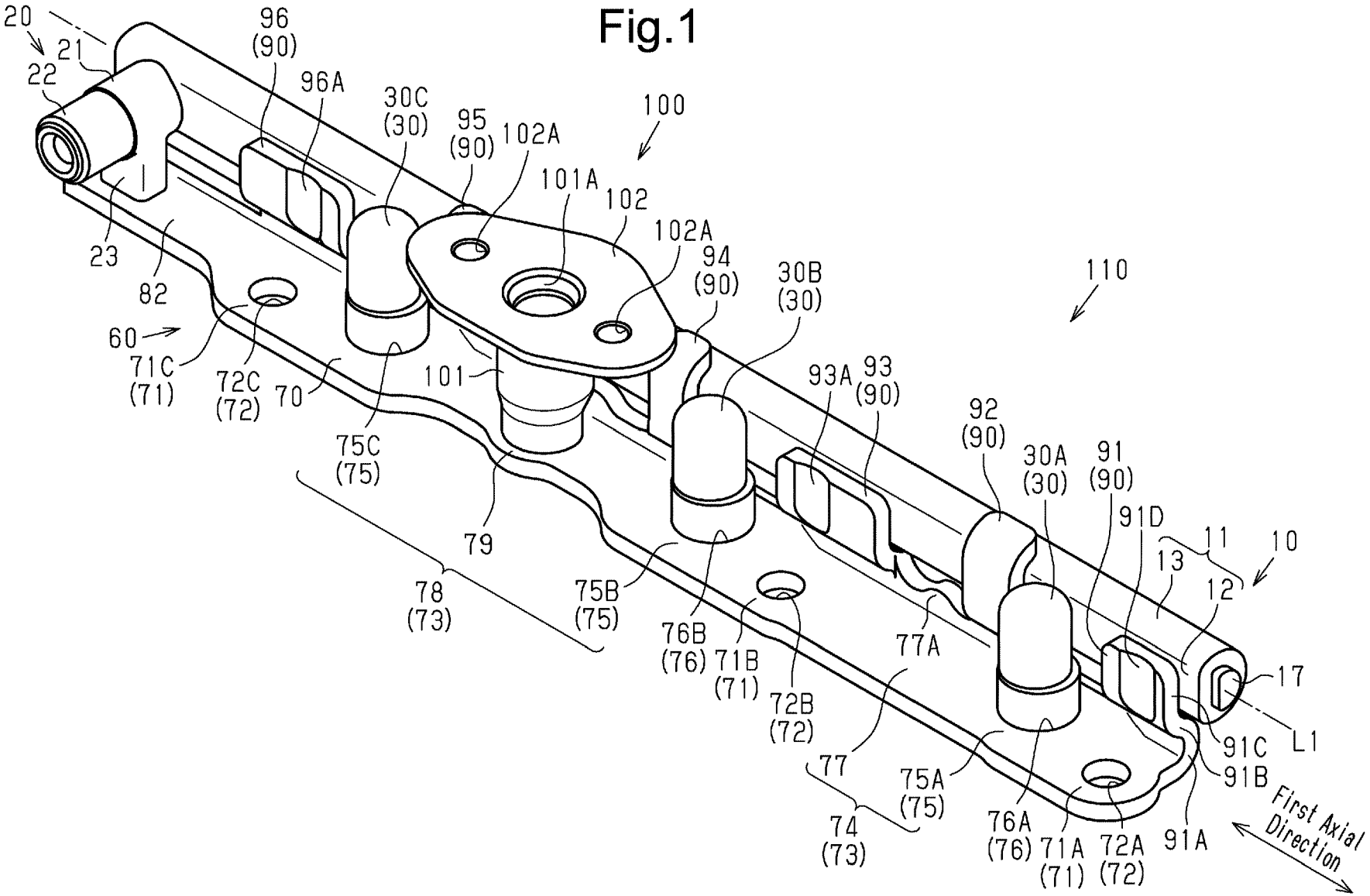
FIG. 1 is a schematic perspective view showing the structure of a fuel pipe according to one embodiment.
Figure 2:
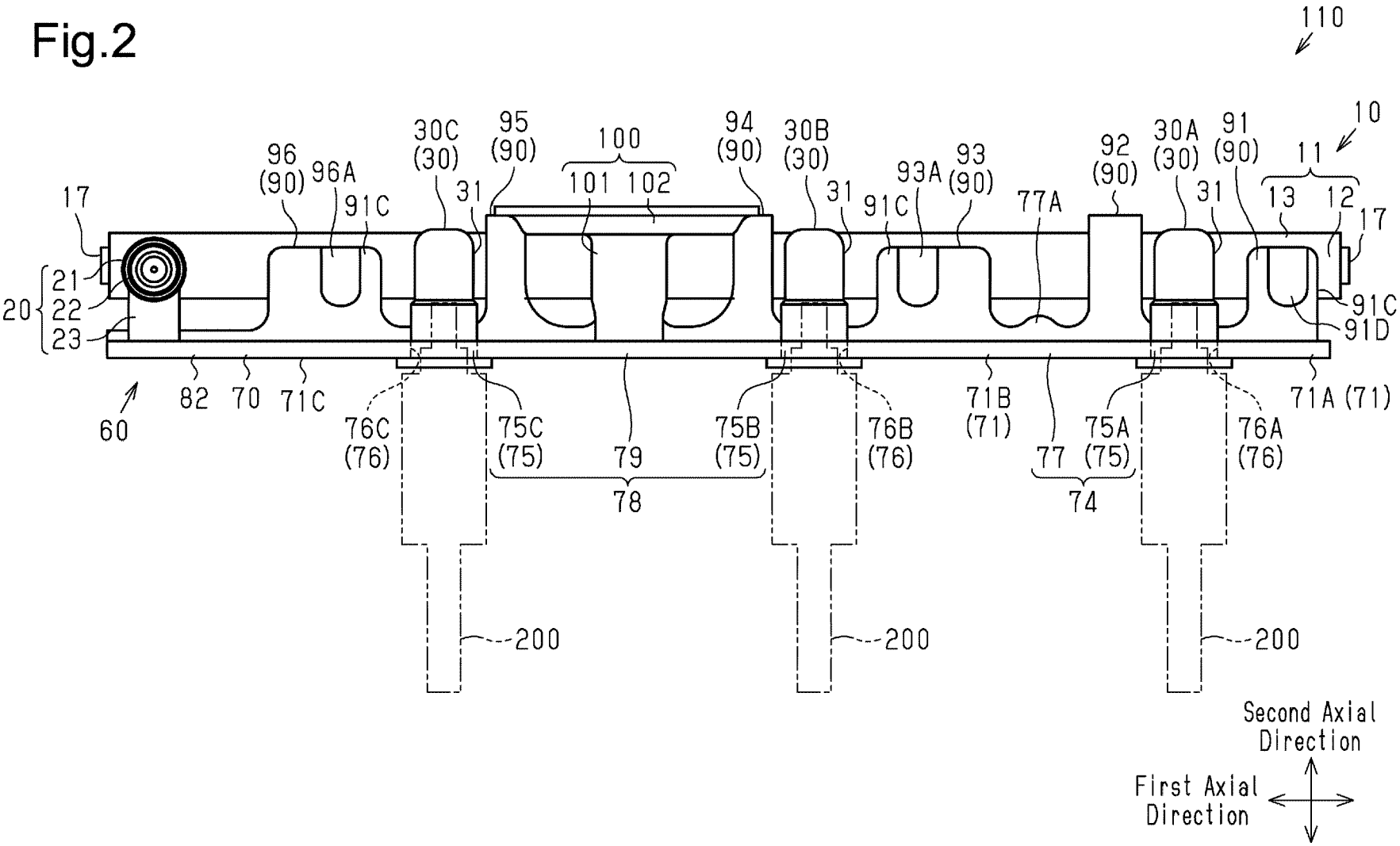
FIG. 2 is a front view of the fuel pipe.
Figure 3:
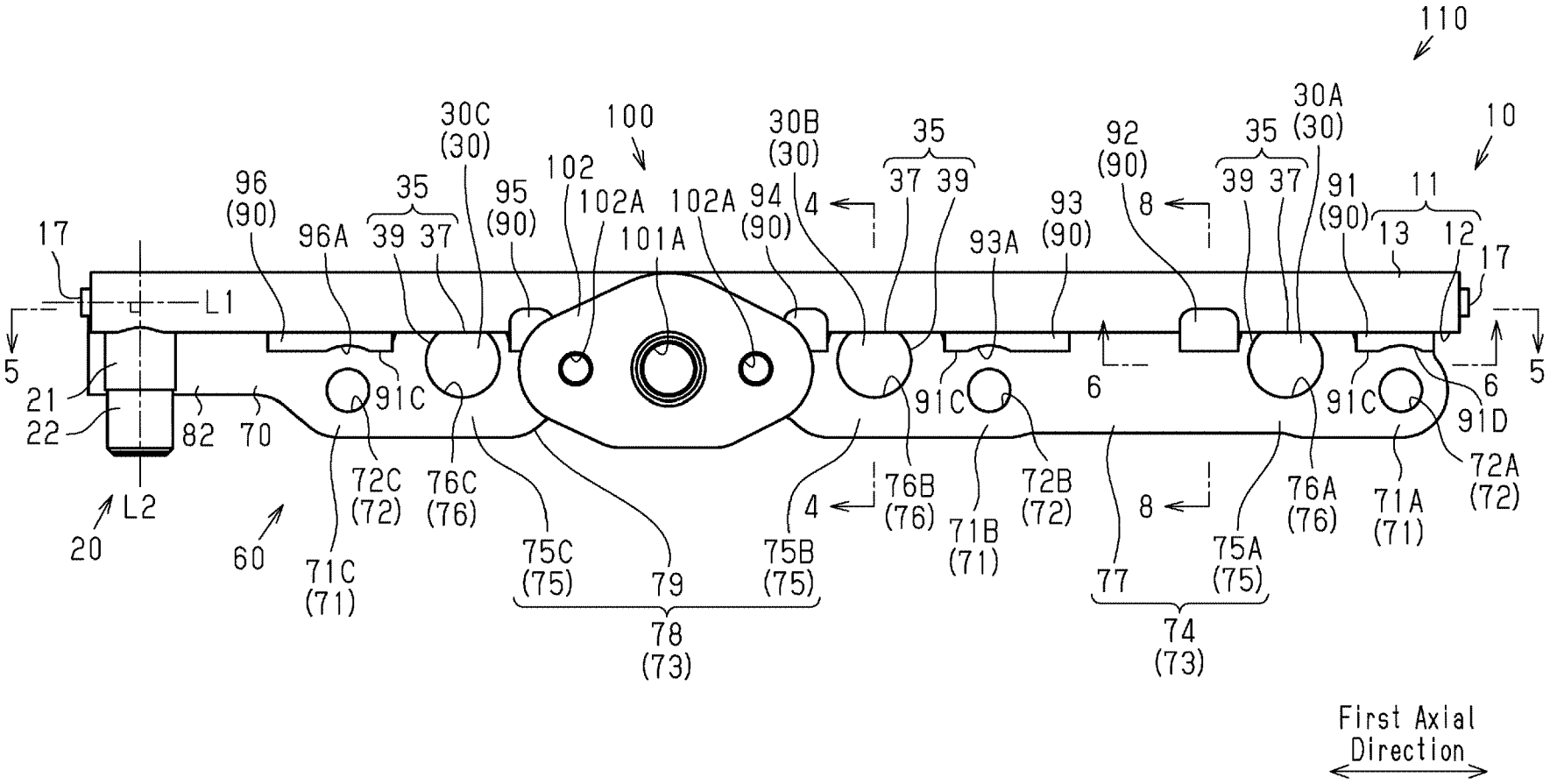
FIG. 3 is a plan view of the fuel pipe.

As shown in FIG. 1, a fuel pipe 110 includes a cylindrical header pipe 10. As shown in FIGS. 2 and 3, the header pipe 10 includes a circumferential wall 11 shaped to form a straight pipe having two open ends. The circumferential wall 11 is made of a metal material such as steel and manufactured by a method such as extrusion molding or pultrusion molding. Two caps 17 are connected to the two ends of the circumferential wall 11. The caps 17 close the open ends of the circumferential wall 11. The cap 17 is made of a metal material such as steel and manufactured by a method such as press molding. In the header pipe 10, the circumferential wall 11 is molded separately from the caps 17 and then coupled together through, for example, brazing. With reference to FIG. 1, the direction in which a center axis L1 of the header pipe 10 extends is referred to as a first axial direction.

Figure 4:
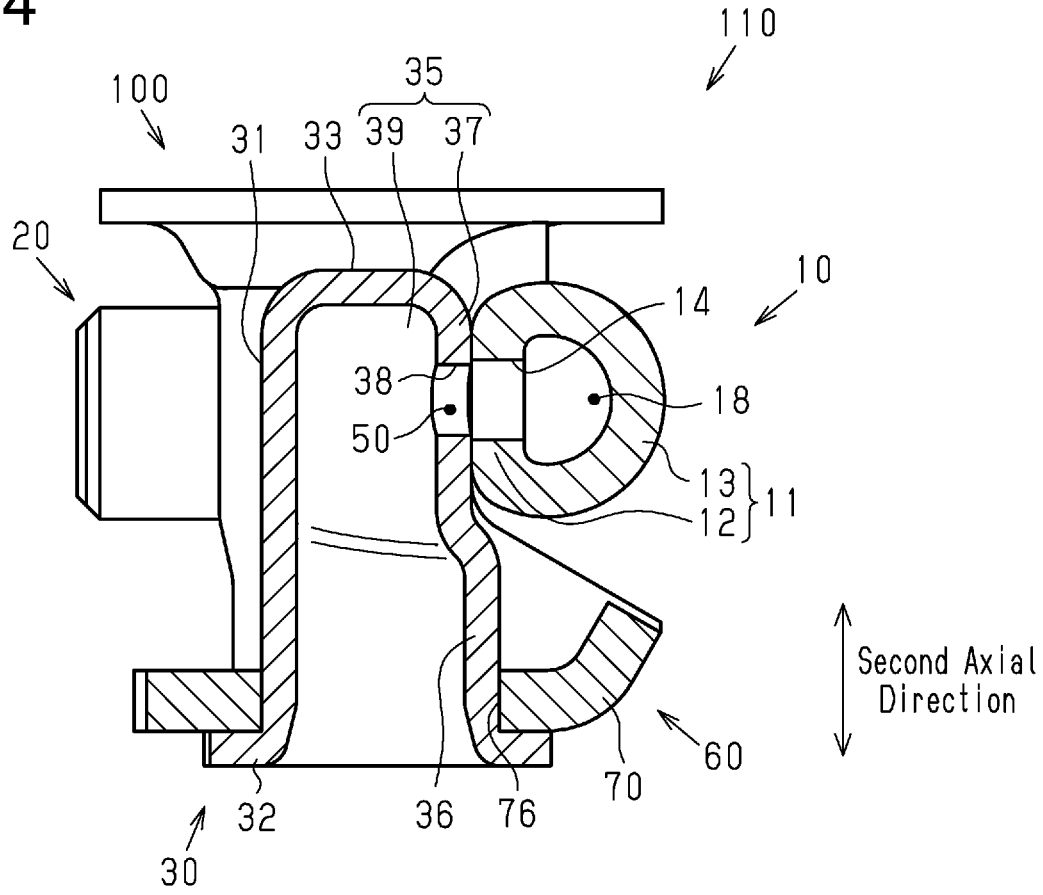
FIG. 4 is a cross-sectional view taken along line 4-4 in FIG. 3.
Figure 5:
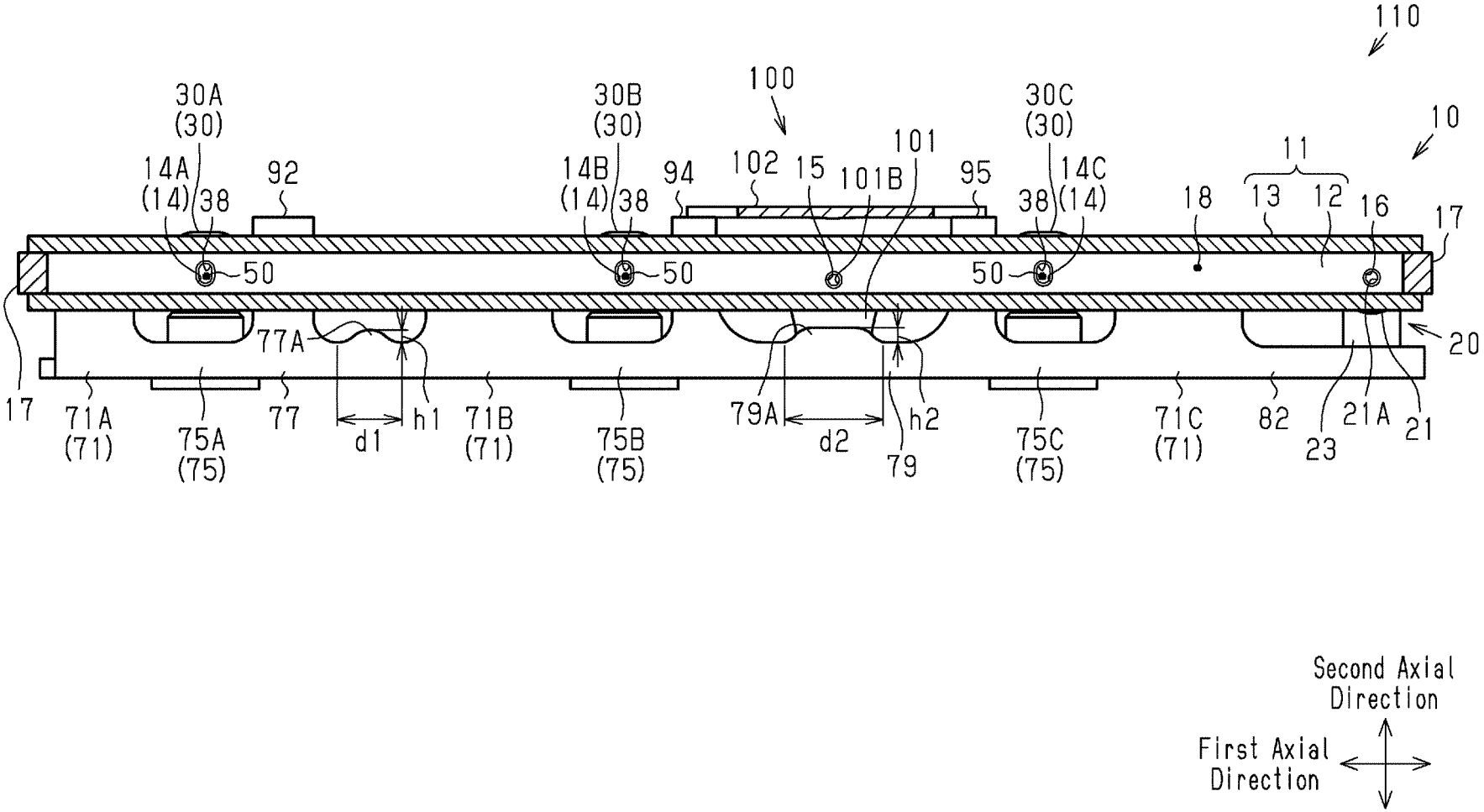
FIG. 5 is a cross-sectional view taken along line 5-5 in FIG. 3.

As shown in FIG. 4, the circumferential wall 11 of the header pipe 10 includes a flat first joining portion 12 and an arcuate first curved portion 13 extending from the first joining portion 12. As shown in FIG. 5, the first joining portion 12 of the header pipe 10 includes a plurality of first through-holes 14 arranged next to one another in the axial direction of the header pipe 10. The first through-holes 14 include an eleventh through-hole 14A arranged at one end in the first axial direction, a twelfth through-hole 14B arranged toward the other end in the first axial direction from the eleventh through-hole 14A, and a thirteenth through-hole 14C arranged toward the other end in the first axial direction from the twelfth through-hole 14B. The first joining portion 12 includes a connection hole 15 located between the twelfth through-hole 14B and the thirteenth through-hole 14C and an inflow hole 16 located toward the other end in the first axial direction from the thirteenth through-hole 14C. The header pipe 10 includes an inflow passage 18 defined by the first joining portion 12 and the first curved portion 13 and connected to the above holes.

As shown in FIG. 1, an inlet 20 is connected to the other end of the header pipe 10. The inlet 20 includes a cylindrical large diameter portion 21, which is connected to the circumferential wall 11 of the header pipe 10, and a small diameter portion 22, which is connected to the large diameter portion 21 and reduced in diameter relative to the large diameter portion 21. The large diameter portion 21 and the small diameter portion 22 are coaxial. The inlet 20 is connected to the header pipe 10 such that a center axis L2 of the large diameter portion 21 and the small diameter portion 22 is orthogonal to the center axis L1 of the header pipe 10 as shown in the plan view of FIG. 3. As shown in FIG. 1, the inlet 20 includes a support base 23 that supports the large diameter portion 21. The support base 23 has the form of a quadrangular post. The large diameter portion 21, the small diameter portion 22, and the support base 23 are formed integrally as a unit.

As shown in FIG. 5, the large diameter portion 21 is connected to the portion of the header pipe 10 including the inflow hole 16. The large diameter portion 21 includes an outflow hole 21A that is in communication with the inflow hole 16. The inside of the large diameter portion 21 is connected to the inflow passage 18 through the inflow hole 16 and the outflow hole 21A.

The outer surface of the small diameter portion 22 of the inlet 20 is threaded. A union nut of a fuel tube (not shown) is fastened to the small diameter portion 22 to connect the fuel tube to the inlet 20. High pressure fuel fed by a high-pressure fuel pump of an internal combustion engine (not shown) is supplied to the fuel tube. The fuel supplied to the fuel tube flows into the inflow passage 18 of the header pipe 10 through the inlet 20.

Figure 6:
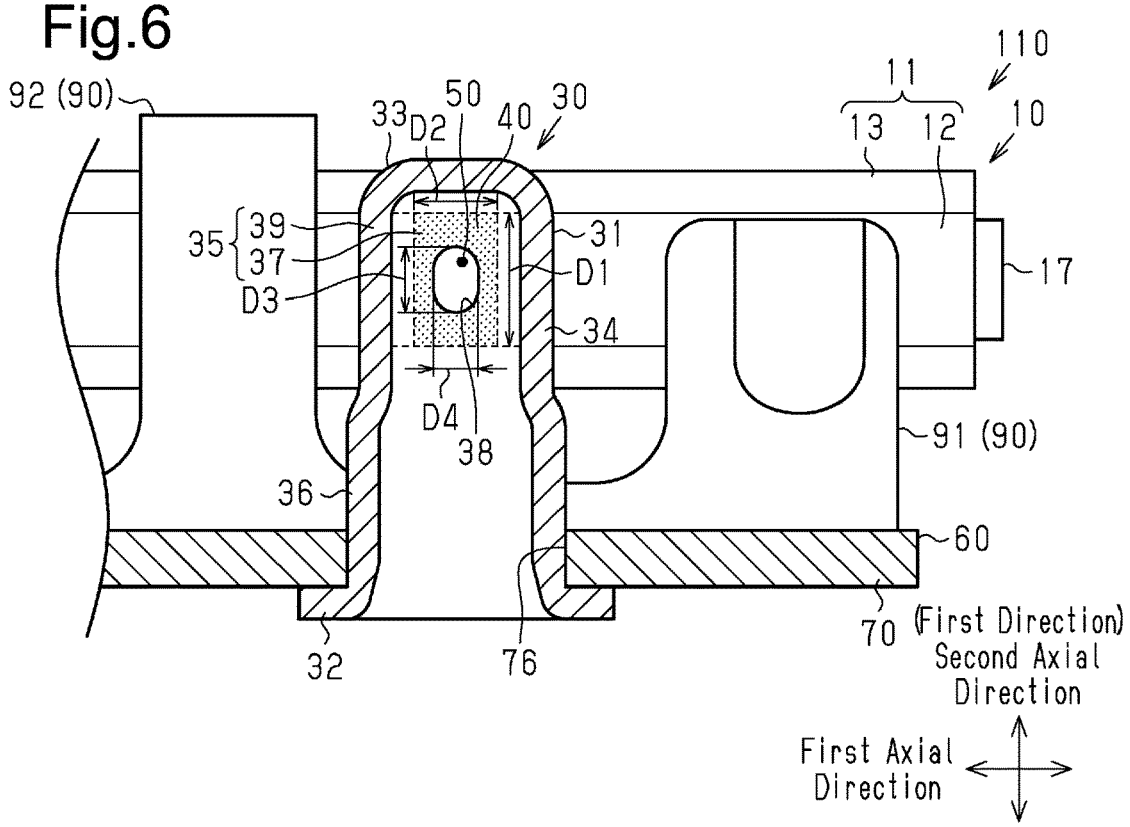
FIG. 6 is a cross-sectional view taken along line 6-6 in FIG. 3.

As shown in FIG. 1, the fuel pipe 110 includes a plurality of sockets 30 connected to the header pipe 10. The sockets 30 are formed by, for example, pressing a metal sheet. As shown in FIG. 6, each socket 30 includes a tubular connection body 31, which has an open end (lower end in FIG. 6) and a closed end, and a flange 32, which extends from the open end of the connection body 31. The connection body 31 includes a bottom wall 33 and a tubular circumferential wall 34 that extends from the circumferential edge of the bottom wall 33. The circumferential wall 34 includes a reduced diameter portion 35, which is located toward the bottom wall 33, and a tubular increased diameter portion 36, which has a larger diameter than the reduced diameter portion 35. The flange 32 is annular and extends outward from one end of the connection body 31.

As shown in FIG. 3, in a plan view of each socket 30, the reduced diameter portion 35 of the circumferential wall 34 in the connection body 31 includes a flat second joining portion 37, which has a flat outer surface, and an arcuate second curved portion 39, which extends from the second joining portion 37. The connection body 31 is connected to the header pipe 10 in a state in which the second joining portion 37 is in planar contact with the first joining portion 12 of the header pipe 10. In other words, the reduced diameter portion 35 of the socket 30 is connected to the header pipe 10, and the increased diameter portion 36 is not connected to the header pipe 10. As shown by the shading in FIG. 6, the header pipe 10 and the socket 30 form a joining portion between the header pipe 10 and the socket 30. Specifically, the first joining portion 12 and the second joining portion 37 define a joining portion 40. The joining portion 40 is rectangular and elongated in the axial direction (vertical direction in FIG. 6) of the socket 30. The axial direction of the socket 30 is referred to as a second axial direction. In the joining portion 40, the length D1 of the longest part in the second axial direction is greater than the length D2 of the longest part in the first axial direction (left-right direction in FIG. 6) of the header pipe 10 (D1>D2). The first joining portion 12 and the second joining portion 37 are designed and shaped based on experiments and simulations so as to satisfy the above dimensional relationship of the joining portion 40 when the first joining portion 12 and the second joining portion 37 are coupled. The second axial direction, which is the axial direction of the socket 30 according to the present embodiment, corresponds to a first direction. As shown in FIG. 4, the second joining portion 37 includes a second through-hole 38.

As shown in FIG. 5, a first socket 30A is connected to a portion of the header pipe 10 where the eleventh through-hole 14A is located, and a second socket 30B is connected to a portion of the header pipe 10 where the twelfth through-hole 14B is located. Further, a third socket 30C is connected to a portion of the header pipe 10 where the thirteenth through-hole 14C is located. The sockets 30 are arranged such that the second through-holes 38 are in communication with the corresponding first through-holes 14. This forms a communication hole 50 that connects the inside of the socket 30 to the inflow passage 18, which is the inside of the header pipe 10. In other words, a communication hole 50 is formed by the second through-hole 38 of the first socket 30A and the eleventh through-hole 14A of the header pipe 10, and another communication hole 50 is formed by the second through-hole 38 of the second socket 30B and the twelfth through-hole 14B of the header pipe 10. A further communication hole 50 is formed by the second through-hole 38 of the third socket 30C and the thirteenth through-hole 14C of the header pipe 10. As shown in FIG. 6, the second through-hole 38 is elliptic and elongated in the second axial direction. Further, as shown in FIG. 5, the first through-hole 14 is also elliptic and elongated in the second axial direction. The first through-hole 14 is slightly larger than and similar in shape to the second through-hole 38. The communication hole 50 formed by the first through-hole 14 and the second through-hole 38 is elongated in the first direction. In other words, as shown in FIG. 6, in the communication hole 50, the length D3 of the longest part in the second axial direction is longer than the length D4 of the longest part in the first axial direction (D3>D4). The major axis directions of the first through-hole 14 and the second through-hole 38, namely, the major axis direction of the communication hole 50 (vertical directions in FIG. 6) corresponds to the first direction. The cross-section of the flow passage at the communication hole 50 has an area corresponding to the area of the region where the first through-hole 14 is overlapped with the second through-hole 38 and is equal to the cross-sectional area of the flow passage at the second through-hole 38 in the present embodiment. Fuel flowing into the inflow passage 18 of the header pipe 10 through the inlet 20 is supplied to each socket 30 through the corresponding communication hole 50.

Figure 7:
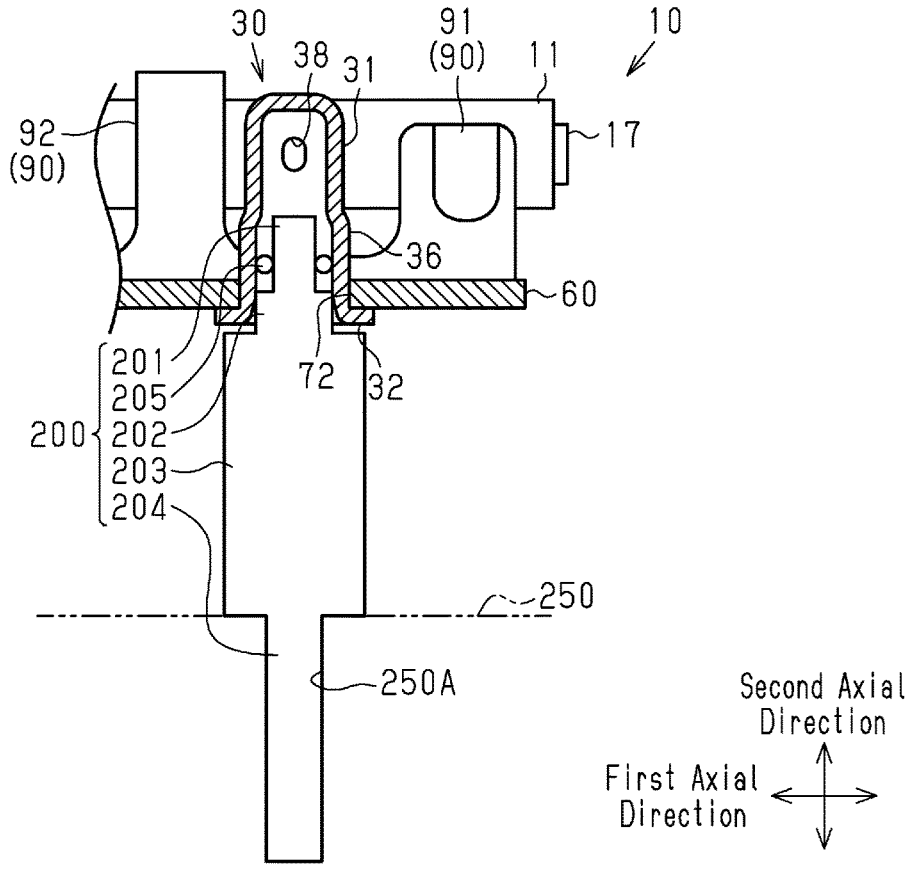
FIG. 7 is a schematic cross-sectional view showing a fuel injection valve coupled to a socket.

A fuel injection valve 200 is coupled to each socket 30 as shown by the double-dashed lines in FIG. 2. The fuel injection valve 200 is inserted and coupled to the open end of the socket 30 in the second axial direction. Fuel supplied to the socket 30 is injected from the fuel injection valve 200 into the combustion chamber of an internal combustion engine (not shown). As shown in FIG. 7, the fuel injection valve 200 is cylindrical and includes a base 201 arranged at an upper end that is closer to the socket 30, a sealing portion 202 increased in diameter from the base 201, a support portion 203 increased in diameter from the sealing portion 202, and an injector 204 reduced in diameter from the support portion 203. In the fuel injection valve 200, the base 201 and the sealing portion 202 are arranged inside the increased diameter portion 36 of the socket 30. The outer diameter of the base 201 is less than the inner diameter of the increased diameter portion 36. The outer diameter of the sealing portion 202 is set to be the same as the inner diameter of the increased diameter portion 36 so that the outer surface of the sealing portion 202 contacts the inner surface of the increased diameter portion 36. An annular seal 205 is attached to the base 201. The seal 205 is arranged between the outer surface of the base 201 and the inner surface of the increased diameter portion 36. The seal 205 prevents fuel leakage from between the socket 30 and the fuel injection valve 200. Further, the fuel injection valve 200 is coupled to a cylinder head 250 of an internal combustion engine shown by the double-dashed lines in FIG. 7. In this state, the injector 204 of the fuel injection valve 200 is inserted into a coupling hole 250A of the cylinder head 250, and an end surface of the support portion 203 abuts on a wall surface of the cylinder head 250. The fuel injection valve 200 is held between the socket 30 and the cylinder head 250. When fuel is injected from the fuel injection valve 200, fuel fed from the inlet 20 to the header pipe 10 is supplied to the fuel injection valve 200 through the socket 30.

As shown in FIG. 1, the fuel pipe 110 includes a bracket 60 that supports the sockets 30. The bracket 60 is flat. The bracket 60 includes a body 70 formed by a rectangular plate and arms 90 extending from the body 70 along the header pipe 10. The longitudinal direction of the body 70 corresponds to the first axial direction. One end of the body 70 in a transverse direction that is orthogonal to the first axial direction extends to below the center axis L1 of the header pipe 10.

As shown in FIG. 2, the body 70 includes a plurality of support holes 76 lined in the longitudinal direction. The support holes 76 are each shaped in conformance with the outer shape of the connection body 31 of the corresponding socket 30. The support holes 76 are arranged in accordance with the arrangement of the sockets 30. The sockets 30 are inserted through the support holes 76. As shown in FIG. 6, each socket 30 is connected to the bracket 60 in a state in which the bottom surface of the body 70 of the bracket 60 is in abutment with the top surface of the flange 32 of the socket 30.

As shown in FIGS. 1 and 3, the body 70 of the bracket 60 includes a plurality of bolt insertion holes 72 of which the diameter is smaller than the support holes 76. Three bolt insertion holes 72 are arranged next to one another in the first axial direction. A first bolt insertion hole 72A is a bolt insertion hole 72 arranged at one end in the first axial direction opposite to the other end where the inlet 20 is connected. A second bolt insertion hole 72B is a bolt insertion hole 72 arranged toward the other end in the first axial direction from the first bolt insertion hole 72A. The second bolt insertion hole 72B is arranged between the first socket 30A and the second socket 30B in the first axial direction. A third bolt insertion hole 72C is a bolt insertion hole 72 arranged toward the other end in the first axial direction from the second bolt insertion hole 72B. The bolt insertion holes 72 are located farther from the header pipe 10 than the support hole 76 in the body 70.

As shown in FIGS. 2 and 3, the body 70 of the bracket 60 includes bolt fastening portions 71, in which the bolt insertion holes 72 are located, and middle portions 73, which are regions between the bolt fastening portions 71. A first middle portion 74 between a first bolt fastening portion 71A where the first bolt insertion hole 72A is located and a second bolt fastening portion 71B where the second bolt insertion hole 72B is located includes a first support portion 75A, where a first support hole 76A that supports the first socket 30A is located, and a first coupling portion 77, which is located between the first support portion 75A and the second bolt fastening portion 71B. Further, a second middle portion 78 is arranged between the second bolt fastening portion 71B and a third bolt fastening portion 71C, which includes the third bolt insertion hole 72C. The second middle portion 78 includes a second support portion 75B, a second coupling portion 79 between the second support portion 75B and the third bolt fastening portion 71C, and a third support portion 75C between the second coupling portion 79 and the third bolt fastening portion 71C. The second support portion 75B includes a second support hole 76B that supports the second socket 30B. The third support portion 75C includes a third support hole 76C that supports the third socket 30C.

As shown in FIG. 2, a first arm 91 extends from the first bolt fastening portion 71A. As shown in FIG. 1, the first arm 91 includes a proximal end 91A, which extends upward from an end of the body 70 in the transverse direction, and a lower covering portion 91B, which is curved from the upper end of the proximal end 91A extending along the outer surfaces of the first joining portion 12 and the first curved portion 13 of the header pipe 10. The first arm 91 also includes a middle covering portion 91C extending upward from the upper end of the lower covering portion 91B and extending along the outer surface of the first joining portion 12 of the header pipe 10. In this manner, the first arm 91 extends upward along the outer surface of the header pipe 10 to an intermediate part of the first joining portion 12. The middle covering portion 91C of the first arm 91 is connected to the first joining portion 12 of the header pipe 10. As shown in FIGS. 1 and 3, the outer surface of the middle covering portion 91C of the first arm 91 includes a first cut-away 91D recessed and shaped in conformance with the edge of the first bolt insertion hole 72A at the same location as the first bolt insertion hole 72A in the first axial direction.

Figure 8:
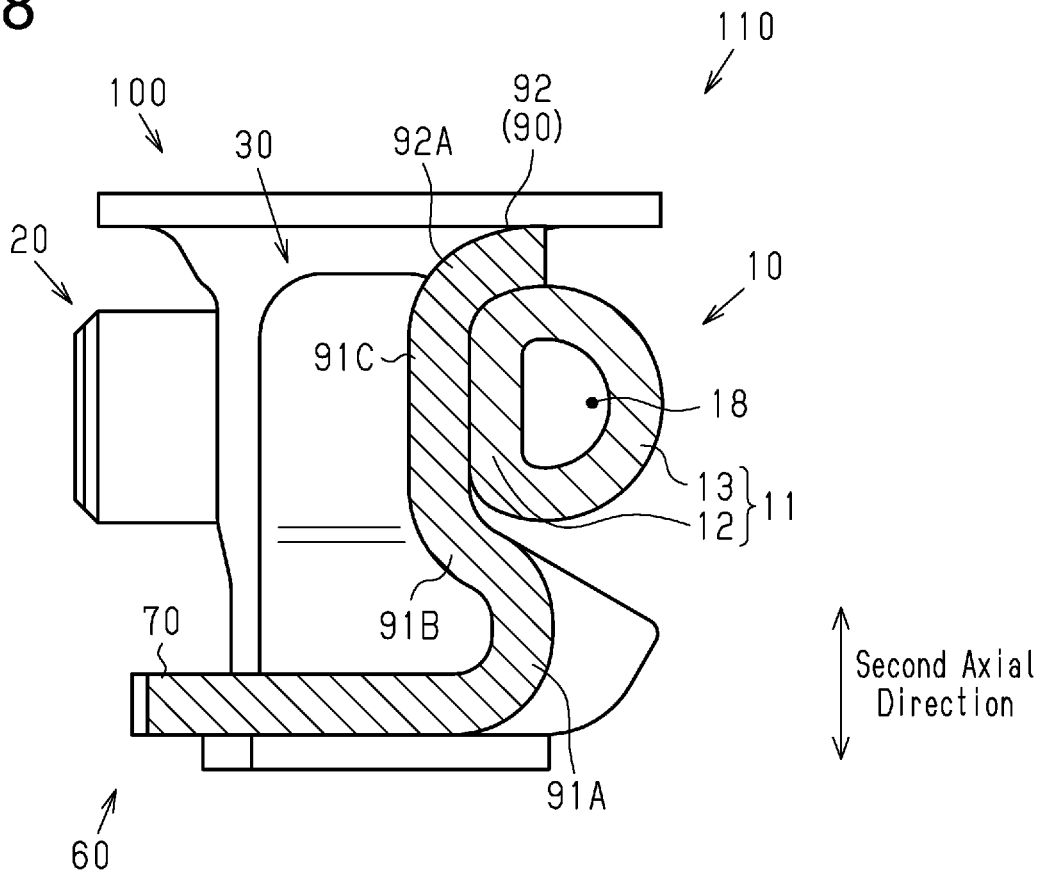
FIG. 8 is a cross-sectional view taken along line 8-8 in FIG. 3.

As shown in FIG. 2, a second arm 92 extends from the first support portion 75A. The second arm 92 is arranged toward the other end in the first axial direction from the first support hole 76A. As shown in FIG. 8, the second arm 92 includes the proximal end 91A, the lower covering portion 91B, and the middle covering portion 91C in the same manner as the first arm 91. The second arm 92 includes an upper covering portion 92A curved from the upper end of the middle covering portion 91C and extending along the outer surfaces of the first joining portion 12 and the first curved portion 13 of the header pipe 10. The lower covering portion 91B, the middle covering portion 91C, and the upper covering portion 92A cover a semicircular portion of the header pipe 10 facing the socket 30 in the circumferential direction. The second arm 92 is connected to the first joining portion 12 and the first curved portion 13 of the header pipe 10.

As shown in FIG. 2, a first rib 77A extends from the first coupling portion 77. The first rib 77A extends in the first axial direction and has a central portion in the first axial direction that projects further toward the header pipe 10 than its end portions. The first rib 77A includes a distal end directed toward the header pipe 10 and a proximal end arranged at the side opposite to the distal end. The first rib 77A is shorter in the first axial direction at the distal end than the proximal end.

As shown in FIG. 2, a third arm 93 extends from the second bolt fastening portion 71B. The third arm 93 extends upward along the outer surface of the header pipe 10. The third arm 93 extends to an intermediate part of the first joining portion 12 of the header pipe 10 and is connected to the first joining portion 12 in the same manner as the first arm 91. As shown in FIGS. 2 and 3, the outer surface of the middle covering portion 91C of the third arm 93 includes a second cut-away 93A recessed and shaped in conformance with the edge of the second bolt insertion hole 72B at the same location as the second bolt insertion hole 72B in the first axial direction.

As shown in FIG. 2, a fourth arm 94 extends from the second support portion 75B. The first middle portion 74 is arranged toward the other end in the first axial direction from the second support hole 76B. The fourth arm 94 extends upward along the outer surfaces of the first joining portion 12 and the first curved portion 13 of the header pipe 10 and covers the semicircular portion of the header pipe 10 in the circumferential direction in the same manner as the second arm 92. The fourth arm 94 is connected to the first joining portion 12 and the first curved portion 13 of the header pipe 10.

As shown in FIG. 1, a holder 100 is connected to the second coupling portion 79. The holder 100 includes a tubular base portion 101 connected to the body 70 of the bracket 60 and having a closed end. The base portion 101 has one end located at the bottom side that is connected to the bracket 60 and another that is open. The other end of the base portion 101 includes a flange 102. As shown in FIG. 3, the flange 102 extends outward from the edge of an opening 101A of the base portion 101 and is triangular in a plan view. The flange 102 extends to above the header pipe 10 such that the flange 102 is partially overlapped with the header pipe 10 in a plan view. The flange 102 includes fastening holes 102A arranged in the axial direction at opposite sides of the opening 101A of the base portion 101. As shown in FIG. 5, the base portion 101 of the holder 100 is connected to a portion of the header pipe 10 where the connection hole 15 is located. The base portion 101 includes a measurement hole 101B, which is in communication with the connection hole 15. Fuel flows from the inflow passage 18 into the base portion 101 through the measurement hole 101B. A sensor (not shown), which detects the fuel pressure inside the header pipe 10, is coupled to the holder 100 so as to close the opening. The sensor, which is secured to the holder 100 by bolts inserted into the fastening holes 102A of the flange 102, detects the pressure of the fuel flowing into the base portion 101 as the fuel pressure inside the header pipe 10.

As shown in FIG. 5, a second rib 79A extends from the second coupling portion 79. The second rib 79A extends in the first axial direction and has a central portion in the first axial direction that projects further toward the header pipe 10 than its two end portions. The second rib 79A includes a distal end directed toward the header pipe 10 and a proximal end located at the side opposite to the distal end. The second rib 79A is shorter in the first axial direction at the distal end than the proximal end. The length d2 of the proximal end of the second rib 79A in the first axial direction is greater than the length d1 of the proximal end of the first rib 77A in the first axial direction (d2>d1). Further, the extension height h2 of the second rib 79A is equal to the extension height h1 of the first rib 77A (h1=h2).

As shown in FIG. 2, a fifth arm 95 extends from the third support portion 75C. The fifth arm 95 is arranged toward the one end in the first axial direction from the third support hole 76C. The fifth arm 95 extends upward along the outer surfaces of the first joining portion 12 and the first curved portion 13 of the header pipe 10 covering the semicircular portion of the header pipe 10 in the circumferential direction in the same manner as the second arm 92. The fifth arm 95 is connected to the first joining portion 12 and the first curved portion 13 of the header pipe 10.

A sixth arm 96 extends from the third bolt fastening portion 71C. The sixth arm 96 extends upward from below along the outer surface of the header pipe 10. The sixth arm 96 extends to an intermediate part of the first joining portion 12 of the header pipe 10 and is connected to the first joining portion 12 in the same manner as the first arm 91. As shown in FIGS. 2 and 3, the outer surface of the middle covering portion 91C of the sixth arm 96 includes a third cut-away 96A recessed and shaped in conformance with the edge of the third bolt insertion hole 72C at the same location as the third bolt insertion hole 72C in the first axial direction.

As shown in FIGS. 1 and 2, the body 70 of the bracket 60 includes an extended portion 82 extending from the third bolt fastening portion 71C to the other end in the first axial direction and extending under the inlet 20. The bracket 60 is formed by, for example, pressing a metal sheet. In other words, the body 70 and the arms 90 of the bracket 60 are cut out with a die from a sheet of metal in a spread out state as a two-dimensional form and then pressed and bent into the bracket 60 as a three-dimensional form. The support base 23 is connected to the extended portion 82 of the bracket 60 to connect the inlet 20 and the bracket 60.

The header pipe 10, the inlet 20, the sockets 30, the bracket 60, and the holder 100 of the fuel pipe 110 are each formed and then brazed to one another to join these members and the coupling locations described above. In the present embodiment, the fuel pipe 110 is brazed in a furnace. After joining the members, the fuel pipe 110 is coupled to an internal combustion engine by fastening bolts inserted into the bolt insertion holes 72 of the bracket 60 to bolt holes of the internal combustion engine in a state in which the fuel injection valves 200 are attached to the sockets 30.

Further, the first rib 77A and the second rib 79A arranged on the bracket 60 have the lengths d1 and d2 in the first axial direction and the extension heights h1 and h2 that are set to be suitable based on experiments and simulations. In other words, the first rib 77A and the second rib 79A are designed to reduce deformation of the bracket 60 and the header pipe 10 that would be caused by heat when manufacturing the fuel pipe 110 and maintain sufficient rigidity of the bracket 60 and the header pipe 10 when coupled to an internal combustion engine.

The operation and advantages of the present embodiment will now be described.

(1) In the present embodiment, the header pipe 10 and the socket 30 are separately formed and coupled to each other. The joining portion 40 of the header pipe 10 and each socket 30 is elongated in the first direction, which is the axial direction of the socket 30. The communication hole 50 is elongated in the first direction, which is the longitudinal direction of the joining portion 40. Thus, when coupling the header pipe 10 and the socket 30, even if the communication hole 50 is elongated in the first direction and enlarged accordingly, a joining area of the joining portion 40 is obtained around the communication hole 50. Thus, the structure coupling the header pipe 10 and each socket 30 increases the area of the communication hole 50 as required while maintaining the joining strength. This reduces vibration of the fuel pipe 110 caused by the difference in fuel pressure of the header pipe 10 and socket 30.

(2) The header pipe 10 includes the flat first joining portion 12, and each socket 30 includes the flat second joining portion 37. The first joining portion 12 and the second joining portion 37 are coupled in planar contact to configure the joining portion 40. This increases the joining area between the header pipe 10 and the socket 30 and easily obtains the coupling strength between the header pipe 10 and the socket 30.

(3) In the present embodiment, the communication hole 50 is configured by joining the first joining portion 12 to the second joining portion 37 such that the first through-hole 14 is overlapped with the second through-hole 38. The first through-hole 14 and the second through-hole 38 are elliptic and shaped to be similar so that the distance between the edge of the first through-hole 14 and the edge of the second through-hole 38 is entirely uniform when positioning the first joining portion 12 and the second joining portion 37 before coupling. This reduces coupling tolerances when the first joining portion 12 and the second joining portion 37 are coupled and easily obtains the dimensional accuracy of the communication hole 50 when the first through-hole 14 is overlapped with the second through-hole 38.

(4) In the present embodiment, the joining portion 40 is rectangular and extended in the first direction so that the dimensions of the joining portion 40 can be designed to satisfy the above relationship by increasing the axial length of the socket 30 without altering the radial length of the open end of the socket 30. The radial length of the socket 30 is set to obtain the required coupling dimensions of the fuel injection valve 200 so that the joining portion 40 is shaped and sized as described above without changing the design of the fuel injection valve 200.

Modifications

The present embodiment may be modified and implemented as follows. The present embodiment and the following modifications may be implemented in combination as long as there are no technical contradictions.

The joining portion 40 is rectangular. Instead, the joining portion 40 may be polygonal or oval. Such a configuration can be implemented by setting the shapes of connection portions in the first joining portion 12 and the second joining portion 37 as required. With such a configuration, the joining portion 40 would still be elongated in the first direction as long as the length D1 of the longest part in the first direction is greater than the length D2 of the longest part in a direction orthogonal to the first direction.

The joining portion 40 may be elongated in a direction other than the second axial direction. For example, the joining portion 40 may be elongated in the first axial direction. In this case, the first axial direction is referred to as the first direction.

The major axis direction of the communication hole 50 corresponds to the first direction. However, the major axis direction of the communication hole 50 may be tilted relative to the first direction. In this case, the communication hole 50 would still be elongated in the first direction as long as the length D3 of the longest part in the first direction is greater than the length D4 of the longest part in a direction orthogonal to the first direction.

The communication hole 50 is elliptic. Instead, the communication hole 50 may be oval or polygonal. Such a configuration can be implemented by, for example, setting the shape of the region in which the first through-hole 14 is overlapped with the second through-hole 38 accordingly.

The shape of the first through-hole 14 and the shape of the second through-hole 38 may be the same. Further, the shape of the second through-hole 38 may be similar to and larger than the shape of the first through-hole 14. In this case, the shape of the communication hole 50 is the same as the shape of the first through-hole 14. Further, the shapes of the first through-hole 14 and the second through-hole 38 do not need to be similar to each other. In other words, the first through-hole 14 may be quadrangular and elongated in the first axial direction and the second through-hole 38 may be quadrangular and elongated in the second axial direction as long as the joining portion 40 is shaped to be elongated in the first direction and the communication hole 50 is shaped to be elongated in the first direction.

The circumferential wall 11 of the header pipe 10 includes the flat first joining portion 12, and the circumferential wall 34 of the socket 30 includes the flat second joining portion 37. These portions are coupled to configure the joining portion 40. Such a configuration may be modified. In other words, the joining portion 40 may be configured by coupling the first curved portion 13 in the circumferential wall 11 of the header pipe 10 to the second curved portion 39 in the circumferential wall 34 of the socket 30 as long as the coupling strength at the joining portion 40 can be maintained. Further, the connection between the header pipe 10 and the socket 30 is not limited to outer walls. For example, the circumferential wall 11 of the header pipe 10 may be coupled to the bottom wall 33 of the socket 30 to configure the joining portion. In such configurations, the communication hole 50 may be arranged at the joining portion.

The holder 100 does not need to be arranged on the fuel pipe 110.

The direction in which the center axis L2 of the inlet 20 extends may be changed. For example, the inlet 20 may be connected to the header pipe 10 at an acute angle or an obtuse angle relative to the center axis L1 of the header pipe 10.

The shape of the support base 23 may be changed. For example, the support base 23 may have a circular or polygonal cross section instead of a quadrangular cross section. The support base 23 may be set such that the cross-sectional area of the support base 23 increases toward the extended portion 82 of the bracket 60. Alternatively, the support base 23 may be set such that the cross-sectional area of the support base 23 decreases toward the extended portion 82.

The shape and the number of the arms 90 arranged on the bracket 60 may be changed. The shape and the number of the sockets 30 of the fuel pipe 110 may also be changed. If the number of the sockets 30 is changed, the number of the support holes 76 formed in the bracket 60 may be changed in accordance with the number of the sockets 30.

The first rib 77A and the second rib 79A are not limited to the extension heights described in the above embodiment. For example, the extension height h1 of the first rib 77A may be greater than the extension height h2 of the second rib 79A (h1>h2) or may be less than the extension height h2 of the second rib 79A (h1<h2).

The first rib 77A and the second rib 79A are not limited to the lengths in the first axial direction described in the above embodiment. For example, the length d1 of the first rib 77A in the first axial direction may be equal to the length d2 of the second rib 79A in the first axial direction (d1=d2). Alternatively, the length d1 of the first rib 77A in the first axial direction may be greater than the length d2 of the second rib 79A in the first axial direction (d1>d2).

The bracket 60 includes the first rib 77A and the second rib 79A in the above embodiment. However, the number of ribs may be changed. For example, a rib other than the first rib 77A and the second rib 79A may be added or either the first rib 77A or the second rib 79A may be removed. Further, the bracket 60 may be free from ribs.

The above embodiment is exemplified in the fuel pipe 110 in which the fuel injection valve 200 is joined with a unit that includes the header pipe 10, the inlet 20, the socket 30, the bracket 60, and the holder 100. Instead, the fuel pipe may include the socket 30 as an element of the fuel injection valve 200. Specifically, the fuel injection valve 200 includes the socket 30, the base 201, the sealing portion 202, the support portion 203, the injector 204, and the seal 205. The fuel pipe, through which fuel flows, may be configured by coupling the socket 30 of the fuel injection valve 200 to a unit that includes the header pipe 10, the inlet 20, the bracket 60, and the holder 100. In this case, part of the fuel injection valve 200 is coupled to the header pipe 10.

The present examples and embodiments are to be considered as illustrative and not restrictive, and the invention is not to be limited to the details given herein, but may be modified within the scope and equivalence of the appended claims.

The invention claimed is:

1. A fuel pipe comprising:

a tubular header pipe; and a socket coupled to the header pipe and supplied with fuel from the header pipe, wherein the header pipe and the socket form a joining portion therebetween shaped to be elongated in a first direction, the joining portion includes a communication hole that connects an inner region of the header pipe and an inner region of the socket, and the communication hole is an elongated hole elongated in the first direction.

2. The fuel pipe according to claim 1, wherein the header pipe includes an outer wall having a flat portion defining a first joining portion, the socket is tubular and includes an outer wall having a flat portion defining a second joining portion, the first joining portion includes a first through-hole, the second joining portion includes a second through-hole, and the first through-hole and the second through-hole are connected to configure the communication hole in a state in which the first joining portion and the second joining portion are coupled to configure the joining portion.

3. The fuel pipe according to claim 2, wherein the first through-hole and the second through-hole have similar shapes.

4. The fuel pipe according to claim 1, wherein the socket is connected to a fuel injection valve supplied with fuel from the header pipe through the socket, and the first direction corresponds to an axial direction of the socket.

* * * * *